US009436138B2

(12) United States Patent
Matsunaka et al.

(10) Patent No.: US 9,436,138 B2
(45) Date of Patent: Sep. 6, 2016

(54) ELECTROPHOTOGRAPHIC IMAGE FORMING FIXING MEMBER, METHOD FOR MANUFACTURING SAID FIXING MEMBER, AND ELECTROPHOTOGRAPHIC IMAGE FORMING APPARATUS

(71) Applicant: CANON KABUSHIKI KAISHA, Tokyo (JP)

(72) Inventors: Katsuhisa Matsunaka, Inagi (JP); Katsuya Abe, Tokyo (JP); Naoki Akiyama, Toride (JP); Yasuhiro Miyahara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/987,623

(22) Filed: Jan. 4, 2016

(65) Prior Publication Data

US 2016/0195838 A1 Jul. 7, 2016

(30) Foreign Application Priority Data

Jan. 6, 2015 (JP) ..... 2015-001045
Mar. 20, 2015 (JP) ..... 2015-057751

(51) Int. Cl.
*G03G 15/20* (2006.01)

(52) U.S. Cl.
CPC ..... *G03G 15/20* (2013.01)

(58) Field of Classification Search
CPC ..... G03G 15/20
USPC ..... 399/333
See application file for complete search history.

(56) References Cited

U.S. PATENT DOCUMENTS 6,137,986 A * 10/2000 Sugino ..... G03G 15/2064 219/216
2012/0294659 A1* 11/2012 Lee ..... G03G 15/2057 399/329

FOREIGN PATENT DOCUMENTS

JP 2014-041342 A 3/2014
JP 2014142377 A 8/2014

* cited by examiner

*Primary Examiner* — Hoang Ngo
(74) *Attorney, Agent, or Firm* — Canon U.S.A., Inc., IP Division

(57) ABSTRACT

A fixing member includes a substrate and an elastic layer on the substrate. The elastic layer comprises a cured product of a silicone rubber composition containing an anatase titanium oxide particle and an addition-curable silicone rubber, and undergoes cohesive failure in 90° peel test specified in JIS K6854-1: 1999. In the fixing member, an allyl group bound to a silicon atom is present at the interface between the substrate and the elastic layer.

8 Claims, 8 Drawing Sheets

ELECTROPHOTOGRAPHIC IMAGE FORMING FIXING MEMBER, METHOD FOR MANUFACTURING SAID FIXING MEMBER, AND ELECTROPHOTOGRAPHIC IMAGE FORMING APPARATUS

BACKGROUND OF THE INVENTION

1. Field of the Invention

The present disclosure relates to a fixing member, a method for manufacturing a fixing member, and an image forming apparatus.

2. Description of the Related Art

In a heat fixing device used in an electrophotographic image forming apparatus, such as a copy machine or a laser printer, in general, a pair of rotation members, such as a roller and a roller, a film and a roller, a belt and a roller, or a belt and a belt, are disposed so as to be pressed against each other. These rotation members form a pressure contact portion (fixing nip) therebetween. When a recording medium such as a paper sheet on which an unfixed toner image has been formed is fed into the pressure contact portion, the toner is fused by heat, thereby being fixed to the recording medium. The rotation member to come into contact with the unfixed toner image on the recording medium is referred to as a fixing member. A known fixing member has a multilayer structure including a substrate, an elastic layer formed of silicone rubber on the outer surface of the substrate, and a surface layer covering the elastic layer and made of fluororesin or any other material capable of easily releasing the toner.

The substrate and the elastic layer are typically bound to each other with an adherent coating liquid called primer. If the elastic layer is a cured product of an addition-curable silicone rubber composition (hereinafter simply referred to as silicone rubber elastic layer), a primer containing a silane coupling agent having an unsaturated aliphatic group is suitable (Japanese Patent Laid-Open No. 2014-142377). This is because the unsaturated aliphatic group of the silane coupling agent reacts with the hydrosilyl group of the crosslinking agent in the addition-curable silicone rubber, thus bonding the substrate and the elastic layer together simultaneously with the curing of the silicone rubber.

In order to ensure high adhesion between the substrate and the elastic layer, the coating film of such a silane coupling agent is baked generally at a high temperature of higher than 120° C. so that the silane coupling agent can react sufficiently with the hydroxyl groups at the surface of the substrate.

The present inventors disclose a technique for increasing the heat resistance of the fixing member, in which titanium oxide particles having an anatase crystal structure (hereinafter referred to as anatase titanium oxide) are added as a heat-resistant filler to the silicone rubber elastic layer (Japanese Patent Laid-Open No. 2014-041342).

SUMMARY OF THE INVENTION

The present disclosure is directed to providing a fixing member where a decrease in adhesion between a silicone rubber elastic layer containing titanium oxide particles having an anatase crystal structure and a substrate is suppressed, as well as a method for manufacturing the fixing member. The present disclosure is also directed to providing an image forming apparatus that can stably provide high-quality images.

According to an aspect of the present disclosure, there is provided a fixing member including a substrate and an elastic layer on the substrate. The elastic layer is a cured product of a silicone rubber composition containing a titanium oxide particle having an anatase crystal structure and an addition-curable silicone rubber. The elastic layer undergoes cohesive failure in 90° peel test specified in JIS K6854-1: 1999. Also, an allyl group bound to a silicon atom is present at the interface between the substrate and the elastic layer.

According to another aspect of the present disclosure, a method for manufacturing a fixing member is provided. The method includes applying a primer containing a silane coupling agent having an allyl group bound to a silicon atom onto a substrate, baking the applied primer at a temperature of 50° C. or more and 120° C. or less, forming a layer of a silicone rubber composition containing an titanium oxide particle having an anatase crystal structure and an addition-curable silicone rubber on the substrate after baking the primer, and curing the silicone rubber in the layer.

Furthermore, still another aspect of the present disclosure is directed to provide an image forming apparatus including a fixing device configured to fix an unfixed toner image on a recording medium to the recording medium by heating and pressing the unfixed toner image. The fixing device includes a fixing member including a substrate and an elastic layer on the substrate. The elastic layer is a cured product of a silicone rubber composition containing a titanium oxide particle having an anatase crystal structure and an addition-curable silicone rubber. The elastic layer undergoes cohesive failure in 90° peel test specified in JIS K6854-1: 1999. Also, an allyl group bound to a silicon atom is present at the interface between the substrate and the elastic layer.

Further features of the present invention will become apparent from the following description of exemplary embodiments with reference to the attached drawings.

DESCRIPTION OF THE EMBODIMENTS

The present inventors have studied about a fixing member including a silicone rubber elastic layer containing anatase titanium oxide particles for bonding the substrate and the silicone rubber elastic layer with a primer disclosed in Japanese Patent Laid-Open No. 2014-142377.

As a result, when the fixing member was used in high temperature atmospheres, the adhesion strength between the substrate and the elastic layer was reduced with time even though any of the primers disclosed in Japanese Patent Laid-Open No. 2014-142377 was used. On the other hand, in a fixing member including a silicone rubber elastic layer containing titanium oxide particles having a rutile crystal structure (hereinafter referred to as rutile titanium oxide particles) instead of anatase titanium oxide particles, the adhesion strength was not reduced with time. It was thus found that the reduction in adhesion with time is unique to the silicone rubber elastic layer containing anatase titanium oxide particles.

The present inventors studied the reason why the adhesion strength to the substrate of the silicone rubber elastic layer containing anatase titanium oxide particles is reduced with time when the silane coupling agent having an unsaturated aliphatic group disclosed in Japanese Patent Laid-Open No. 2014-142377 is used.

Japanese Patent Laid-Open No. 2014-142377 discloses silane coupling agents having vinyl or methacryl as the unsaturated aliphatic group. These unsaturated aliphatic groups generally react with the hydrosilyl group of the crosslinking agent in the addition-curable silicone rubber, thus binding to the silicone rubber. The present inventors therefore assumed that the chemical bonds between the silane coupling agent of Japanese Patent Laid-Open No. 2014-142377 and the silicone rubber elastic layer are gradually broken by the oxidizing action of the anatase titanium oxide particles.

Figure 3:
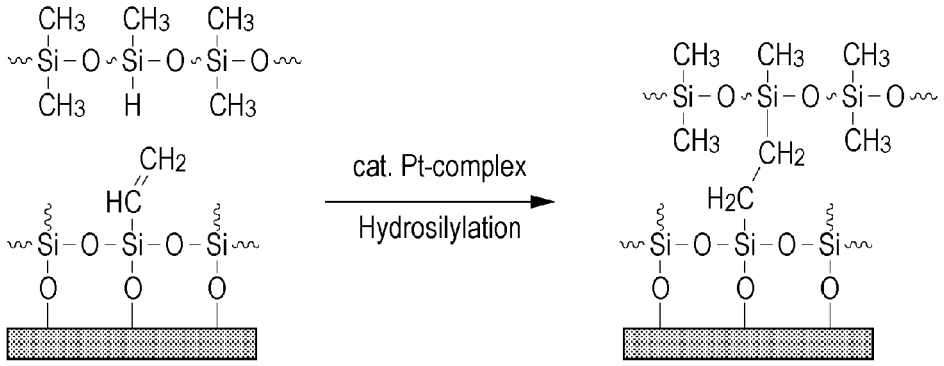
FIG. 3 is an illustrative representation of a reaction between vinyltrimethoxysilane and a crosslinking agent in an addition-curable silicone rubber.

FIG. 3 is an illustrative representation of a reaction between a crosslinking agent in an addition-curable silicone rubber and vinyltrimethoxysilane acting as the silane coupling agent having a vinyl group.

As shown in FIG. 3, the vinyl group of vinyltrimethoxysilane forms a $\delta Si\text{-}CH_2—CH_2—Si\equiv$ bond with the hydrosilyl group of the crosslinking agent in the addition-curable silicone rubber by hydrosilylation. Probably, the methylene structure of this bond is less resistant to oxidation, and accordingly the bond is likely to be broken by the action of anatase titanium oxide particles.

Figure 4:
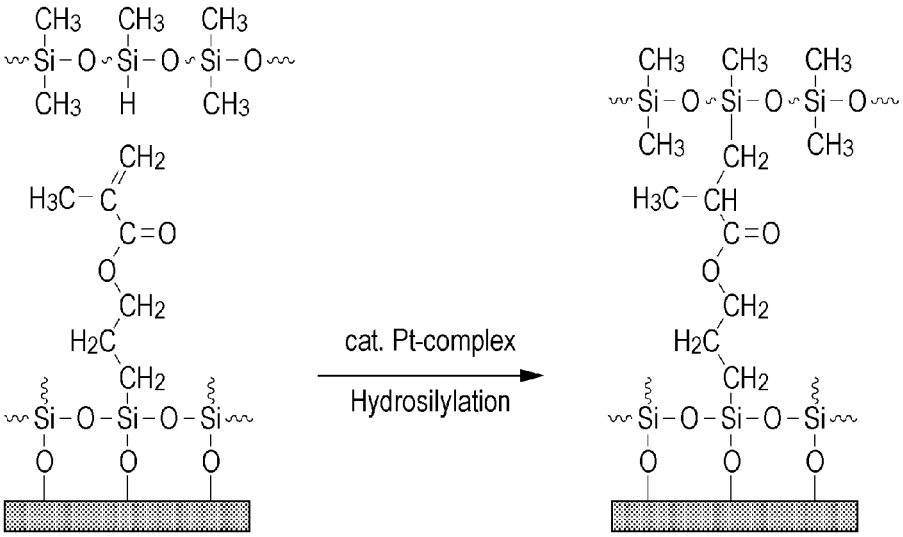
FIG. 4 is an illustrative representation of a reaction between 3-methacryloxypropyltrimethoxysilane and a crosslinking agent in an addition-curable silicone rubber.

FIG. 4 is an illustrative representation of a reaction between 3-methacryloxypropyltrimethoxysilane and a crosslinking agent in an addition-curable silicone rubber. The methacryloxy group reacts with the hydrosilyl group of the crosslinking agent in the addition-curable silicone rubber to form a $\equiv Si—CH_2—CH_2—CH_2—O—CO—CH(CH_3)—CH_2—Si\equiv$ bond. In this bond, the carbon atom at the α-position adjacent to the carbonyl group (CO) is easy to oxidize with anatase titanium oxide particles. This is probably the cause why the bond is broken.

On the basis of the above considerations, the present inventors studied for a technique for maintaining high adhesion strength between the substrate and the silicone rubber elastic layer and found that it is effective to allow allyl groups bound to silicon atoms (hereinafter referred to as silicon-bound allyl group) to be present at the interface between the substrate and the elastic layer. The present inventors assume that this advantageous effect is produced by the following mechanism.

Figure 2:
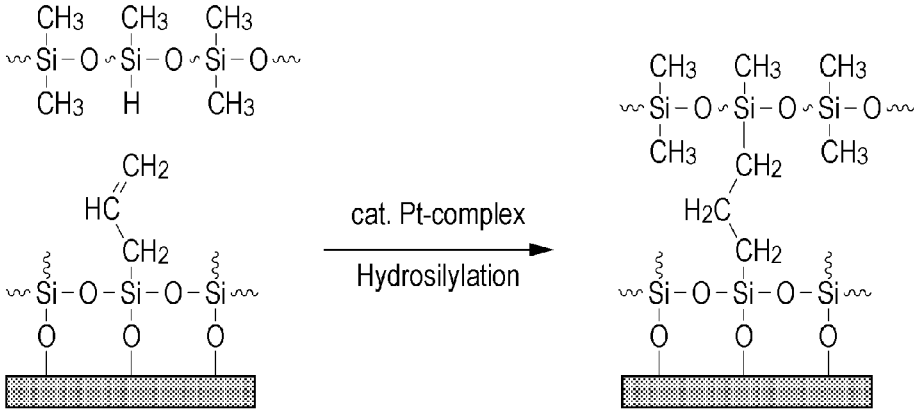
FIG. 2 is an illustrative representation of a reaction between allyltrimethoxysilane and a crosslinking agent in an addition-curable silicone rubber.

FIG. 2 is an illustrative representation of a reaction between a crosslinking agent in an addition-curable silicone rubber and allyltrimethoxysilane acting as a silane coupling agent having a silicon-bound allyl group. The allyl group in this silane coupling agent forms a $\equiv Si—CH_2—CH_2—CH_2—Si\equiv$ bond with the hydrosilyl group of the crosslinking agent in the addition-curable silicone rubber by hydrosilylation. In this bond, probably, the trimethylene structure between silicon atoms is resistant to oxidation, and accordingly, the bond is unlikely to be broken by anatase titanium oxide particles.

In addition, if part of the silane coupling agent having a silicon-bound allyl group remains unreacted, that is, if the silicon-bound allyl group is present at the interface between the substrate and the elastic layer, the allyl group forms another chemical bond with the silicone rubber in the elastic layer, between the substrate and the elastic layer under a high temperature environment by radical addition reaction. It is thought that the adhesion strength between the substrate and the elastic layer is thus kept from decreasing and can be maintained over a long time.

According to an embodiment of the present disclosure, there is provided a fixing member where a decrease in adhesion between a silicone rubber elastic layer containing titanium oxide particles having an anatase crystal structure and a substrate is suppressed, and a method for forming the fixing member. Also, according to another embodiment of the present disclosure, there is provided an image forming apparatus that can stably form high-quality images.

The fixing member according to an embodiment of the present disclosure will now be described in detail.

1. Fixing Member

Figure 1:
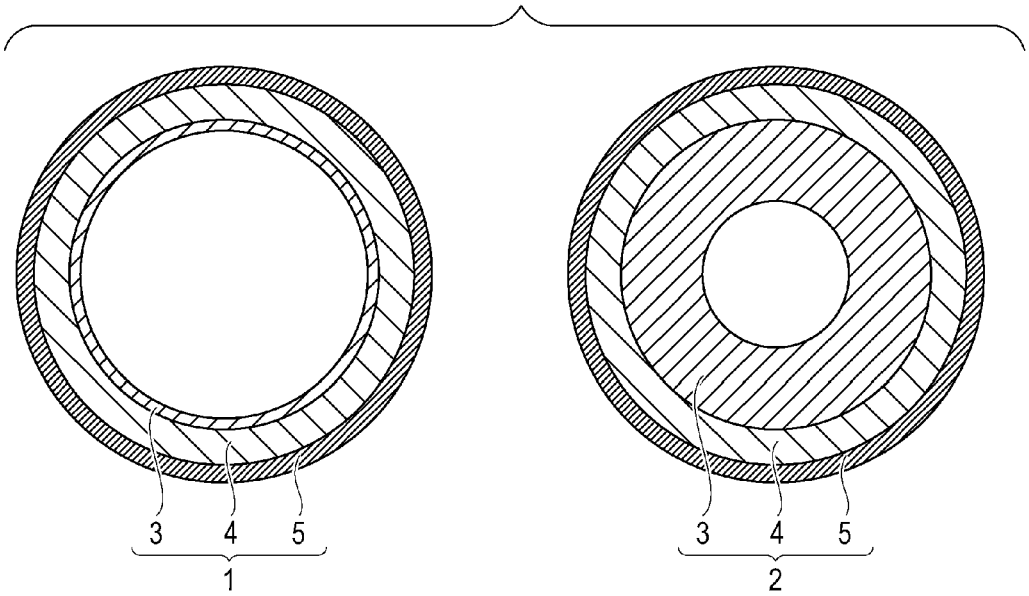
FIG. 1 is a schematic sectional view of fixing members according to an embodiment of the present disclosure.

FIG. 1 is a schematic sectional view of a fixing belt 1 and a fixing roller 2 that are each an exemplary fixing member according to an embodiment of the present disclosure. In general, a fixing member in which a fixing nip is formed by changing the shape of the substrate 3 is called a fixing belt, and a fixing member in which a fixing nip is formed by elastically changing the shape of the elastic layer 4 with the substrate 3 hardly changing in shape is called a fixing roller.

In FIG. 1, each fixing member includes a substrate 3, an elastic layer 4 covering the outer periphery of the substrate 3, and a surface layer 5 covering the periphery of the elastic layer 4. Silicon-bound allyl groups are present at the interface between the substrate 3 and the elastic layer 4. The surface layer 5 may be fixed to the periphery of the elastic layer 4 with an adhesion layer (not shown). The elastic layer 4 may have a multilayer structure.

The layers of the fixing member will now be described in detail.

(1) Substrate

The substrate 3 is made of a metal, such as aluminum, iron, stainless steel, or nickel, or an alloy thereof, or a heat-resistant resin such as polyimide.

For a fixing member in the form of a roller, a mandrel is used as the substrate 3. The mandrel is made of a metal, such as aluminum, iron, or stainless steel, or an alloy thereof. The mandrel may be hollow as long as it is resistant to the pressure of the fixing device. The hollow mandrel may be provided with a heat source therein.

For a fixing member in the form of a belt, the substrate 3 may be an electroformed nickel sleeve, a stainless steel sleeve, or a heat-resistant resin belt. The sleeve or belt may be provided with a layer (not shown) on the inner surface thereof for imparting abrasion resistance or thermal insulation.

The surface of the substrate 3 may be subjected to physical treatment such as blasting, lapping, or polishing.

The substrate 3 of a belt-shaped fixing member may have a thickness of 15 μm or more and 80 μm or less. In the case of a roller-shaped fixing member, the substrate is appropriately designed so as not to be easily deformed by the pressure of the fixing device.

(2) Elastic Layer

The elastic layer 4 is a cured product of a silicone rubber composition containing anatase titanium oxide particles and an addition-curable silicone rubber.

The addition-curable silicone rubber is advantageously used because filler (described later) can be dispersed easily therein and also because the elasticity of the elastic layer 4 can be easily controlled by changing the degree of crosslinking thereof depending on the type of filler and the amount of the filler to be added.

The silicone rubber composition may be prepared by mixing the following materials.

(2-1) Addition-Curable Silicone Rubber

The composition of the addition-curable silicone rubber contains the following fundamental constituents (a), (b) and (c):

(a) organopolysiloxane having an unsaturated aliphatic group;

(b) organopolysiloxane having one or more hydrosilyl groups; and (c) a hydrosilylation catalyst.

Examples of constituent (a), namely an organopolysiloxane having one or more unsaturated aliphatic groups, include:

a linear organopolysiloxane whose molecule includes terminals expressed by $R1_2R2SiO_{1/2}$ and an intermediate unit expressed by $R1_2SiO$ and R1R2SiO; and a branched organopolysiloxane whose molecule includes terminals expressed by $R1_2R2SiO_{1/2}$ and an intermediate unit expressed by $R1SiO_{3/2}$ and/or $SiO_{4/2}$.

R1 represents a substituted or unsubstituted monovalent hydrocarbon group bound to a silicon atom and not containing an unsaturated aliphatic group. Examples of R1 include alkyl, such as methyl, ethyl, n-propyl, n-butyl, n-pentyl, and n-hexyl; aryl, such as phenyl and naphthyl; substituted hydrocarbon, such as chloromethyl, 3-chloropropyl, 3,3,3-trifluoropropyl, 3-cyanopropyl, and 3-methoxypropyl.

It is advantageous that methyl account for 50% (more advantageously 100%) of R1. Such an organopolysiloxane is easy to synthesize and exhibits high heat resistance.

R2 represents an unsaturated aliphatic group bound to a silicon atom. Exemplary groups represented by R2 include vinyl, aryl, 3-butenyl, 4-pentenyl, and 5-hexenyl, and vinyl is advantageous from the viewpoint of easy synthesis and handling and easy crosslinking reaction of the silicone rubber.

Constituent (b), namely an organopolysiloxane having one or more hydrosilyl groups, is a crosslinking agent that reacts with the alkenyl group of constituent (a) to form a cross-linked structure in the presence of a platinum compound as a catalyst.

Desirably, constituent (b) has more than three hydrosilyl groups on average in the molecule thereof. The organic group bound to a silicon atom may be the same substituted or unsubstituted monovalent hydrocarbon group as R1 of constituent (a) that is organopolysiloxane having an unsaturated aliphatic group. Advantageously, it is methyl from the viewpoint of easy synthesis and handling. The molecular weight of the organopolysiloxane having one or more hydrosilyl groups is not particularly limited.

The viscosity of constituent (b) at 25° C. is desirably 10 $mm^2/s$ or more and 100,000 $mm^2/s$ or less, more desirably 15 $mm^2/s$ or more and 1,000 $mm^2/s$ or less. Constituent (b) having a viscosity of 10 $mm^2/s$ or more is not easily evaporated and can provide a silicone rubber having a desired degree of crosslinking and desired physical properties. Also, constituent (b) having a viscosity of 100,000 $mm^2/s$ or less is easy to handle and can be easily dispersed in a system.

The siloxane skeleton of constituent (b) may be linear, branched, cyclic, or a mixture of such forms. From the viewpoint of easy synthesis, a linear siloxane skeleton is advantageous.

The Si—H bonds of constituent (b) may be present in any siloxane unit of the molecule. Advantageously, at least some of the Si—H bonds are present at an end of the organopolysiloxane molecule, as in a unit of $R1_2HSiO_{1/2}$.

Advantageously, the contents of constituents (a) and (b) in the addition-curable silicone rubber composition are controlled so that the ratio of the number of unsaturated aliphatic groups to the number of silicon atoms can be 0.001 or more and 0.020 or less, more advantageously 0.002 or more and 0.010 or less. Advantageously, the proportions of the constituents are controlled so that the ratio of the number of active hydrogens to the number of unsaturated aliphatic groups can be 0.3 or more and 0.8 or less. When the ratio of the number of active hydrogens is 0.3 or more to the number of unsaturated aliphatic groups, the resulting cured silicone rubber stably has a desired hardness. When the ratio of the number of active hydrogens is 0.8 or less to the number of unsaturated aliphatic groups, the silicone rubber is prevented from having an excessively high hardness. The ratio of the number of active hydrogens to the number of unsaturated aliphatic groups can be determined by measuring the numbers of unsaturated aliphatic groups and active hydrogens by proton nuclear magnetic resonance analysis (1H-NMR) with an FT-NMR analyzer, model AL 400 (manufactured by JEOL).

Constituent (c) may be a known hydrosilylation catalyst, such as a platinum compound or a rhodium compound.

The addition-curable silicone rubber composition may further contain a reaction inhibitor, in addition to the above-described constituents (a) to (c). The reaction inhibitor may be selected from among known materials such as methylvinyltetrasiloxane, acetylene alcohols, siloxane-modified acetylene alcohols, and hydroperoxide.

(2-2) Titanium Oxide Particles Having Anatase Crystal Structure

The elastic layer 4 contains titanium oxide particles having an anatase crystal structure (hereinafter referred to as anatase titanium oxide particles) for imparting heat resistance to the elastic layer 4.

From the viewpoint of satisfactorily producing the intended effect of the present disclosure, the content of the anatase titanium oxide particles may be 0.2 part by mass or more and 20 parts by mass or less relative to 100 parts by mass of silicone rubber base polymer. Desirably, it is 1 part by mass or more and 5 parts by mass or less. When the content of the anatase titanium oxide particles is 0.2 part by mass or more, the elastic layer 4 exhibits satisfactory elasticity. Also, when the content of the anatase titanium oxide particles is 20 parts by mass or less, the silicone rubber composition is prevented from increasing in structural viscosity.

The heat resistance of the elastic layer 4 is ensured by adding a small amount of anatase titanium oxide particles, and the volume average primary particle size of the anatase titanium oxide particles is desirably as small as possible. More specifically, the volume average primary particle size of the anatase titanium oxide particles may be 5 nm or more and 100 nm or less, such as 20 nm or more and 40 nm or less.

The volume average primary particle size of the anatase titanium oxide particles in the elastic layer 4 can be measured with a flow particle image analyzer FPIA-3000 (produced by Sysmex). More specifically, the rubber component in a sample cut out of the elastic layer 4 is decomposed to be removed by heating the sample to 1000° C. in a crucible in a nitrogen atmosphere. Subsequently, the crucible is heated to 1000° C. in an air atmosphere for firing vapor-phase-grown carbon fiber. Consequently, only titanium oxide particles that have been contained in the sample remain in the crucible. The titanium oxide particles remaining in the crucible are crushed into primary particles in a mortar with a pestle, and then dispersed in water to yield a liquid sample. The liquid sample is introduced to the above-mentioned particle image analyze so as to pass through an imaging cell in the analyzer. A still image of the titanium oxide particles is thus taken.

The diameter of the titanium oxide particles is defined as the diameter of circles having an area equivalent to the area of particles projected as an image to a plane. Thus, the areas of circles equivalent to the areas of projected particles (hereinafter referred to as area-equivalent circles) of 1000 titanium oxide particles are obtained, and the arithmetic average of the area-equivalent circles is defined as the volume average primary particle size of titanium oxide particles.

The crystal structure of the titanium oxide particles can be identified by X-ray diffraction (XRD). This X-ray diffraction may be performed with a sample-horizontal multi-purpose X-ray diffractometer Ultima IV (manufactured by Rigaku) under the following conditions:

X-ray source: Cu-Kα
Tube voltage/current: 30 kV/20 mA
Scanning range: 10° to 80°
Scanning speed: 2.0°/min
Sampling speed: 0.01°
Integration count: 3

The strongest diffraction peak peculiar to the plane index (101) of anatase titanium oxide crystal can be observed around $2\theta=25.3°$ in the resulting X-ray diffraction profile.

(2-3) Filler

The elastic layer 4 may further contain a filler to impart thermal conductivity, heat resistance and reinforcing property thereto.

Advantageously, the filler has a high thermal conductivity. Such a filler may be a metal, a metal compound, or carbon fiber. Examples of high thermal-conductivity filler include silicon carbide (SiC), silicon nitride ($Si_3N_4$), boron nitride (BN), aluminum nitride (AlN), alumina ($Al_2O_3$), zinc oxide (ZnO), magnesium oxide (MgO), silica ($SiO_2$), copper (Cu), aluminum (Al), silver (Ag), iron (Fe), nickel (Ni), vapor-phase-grown carbon fiber, PAN (polyacrylonitrile)-based carbon fiber, and pitch-based carbon fiber. These fillers may be used singly or in combination.

It is advantageous that the filler have an average particle size of 1 μm or more and 50 μm or less from the viewpoint of handling and dispersibility. The particles of the filler may be in the form of spheres, crushed powder, needles, plates, or whiskers. Spherical fillers are particularly advantageous from the viewpoint of dispersibility.

The volume of the filler in the elastic layer 4 is desirably 30% by volume or more and 60% by volume or less relative to the addition-curable silicone rubber, from the viewpoint of satisfactorily achieving the function of the filler.

(3) Formation of Elastic Layer

For forming the elastic layer 4, the silicone rubber composition is applied so as to be supported on the outer periphery of the substrate 3 by die molding, blade coating, nozzle coating, ring coating, or the like, and the coating of the composition is heated. In the present embodiment, the substrate 3 is surface treated with a primer, which will be described later.

A surface of the resulting elastic layer 4 may be irradiated with UV light. The UV irradiation prevents the adhesive used between the surface layer 5 and the elastic layer 4 from penetrating the elastic layer 4. A UV source capable of emitting UV light having a wavelength of 185 nm may be used. For example, such a UV source may be a low-pressure mercury-vapor lamp.

Desirably, UV light of 185 nm in wavelength is emitted so that the cumulative quantity of light per unit area can become 300 mJ/cm$^2$ or more and 1000 mJ/cm$^2$ or less. The quantity of emitted UV light can be measured with a UV power meter C8026/H8025-18510 produced by Hamamatsu Photonics.

The thickness of the elastic layer 4 can be appropriately set in view of contributing to the surface hardness of the fixing member and ensuring a nip width. For a belt-shaped fixing member 4, the thickness thereof is desirably 100 μm or more and 500 μm or less, and more desirably 200 μm or more and 400 μm or less. The elastic layer 4 having a thickness in such a range allows the substrate 3 to change sufficiently in shape to ensure a sufficient nip width when the fixing belt is installed in a fixing device. Also, the elastic layer 4 having a thickness in such a range can efficiently conduct heat from a heat source that may be provided in the belt. For a roller-shaped fixing member, the substrate 3 is made of a rigid material. A nip therefore needs to be formed by the change in shape of the elastic layer 4. Accordingly, the thickness of the elastic layer 4 in this instance is larger than that in the case of fixing belt. More specifically, the thickness of the elastic layer 4 is desirably in the range of 300 μm or more and 10 mm or less, and more desirably in the range of 1 mm or more and 5 mm or less.

For the strength of the elastic layer 4, the tensile strength (TS) measured using a dumbbell shaped No. 3 test piece in accordance with JIS K6251: 2010 is desirably 0.4 MPa or more and 3.0 MPa, such as 1.0 MPa or more and 2.5 MPa or less. The strength in such a range is sufficient as the elastic layer 4 of the fixing member.

The tensile strength of the elastic layer 4 can be increased by increasing the degree of crosslinking of the organopolysiloxane in the silicone rubber composition. For example, this can be achieved by increasing the proportion of unsaturated aliphatic groups and hydrosilyl groups relative to the number of silicon atoms.

(4) Bonding of Elastic Layer and Substrate

In the fixing member disclosed herein, silicon-bound allyl groups are present at the interface between the substrate 3 and the elastic layer 4.

The fixing member may be produced by bonding the substrate 3 and the elastic layer 4 together with a liquid primer containing a silane coupling agent having a silicon-bound allyl group so that the allyl groups can be present at the interface between the substrate 3 and the elastic layer 4. Hence, the allyl group derives from the silane coupling agent having a silicon-bound allyl group applied on the substrate 3.

(4-1) Silane-Coupling Agent Containing Silicon-Bound Allyl Group

The silane coupling agent used as the adhesive between the substrate 3 and the elastic layer 4 has an allyl group bound to a silicon atom.

The silane coupling agent having a silicon-bound allyl group may be an organic silicon compound expressed by the following formula (1) or a condensate thereof:

$$CH_2{=}CH{-}CH_2{-}Si({-}CH_3)_{3-n}({-}OR)_n \quad (1)$$

In formula (1), —OR represents a hydrolyzable group, and n represents an integer of 1 to 3. The —OR is hydrolyzed and then dehydrated (condensed) with the OH groups at the surface of the substrate 3, thus binding firmly to the substrate 3. Examples of the —OR group include alkoxy, such as methoxy, ethoxy, isopropoxy, and phenoxy; and carboxy, such as acetoxy, a propionate group, and a butanoate group. Methoxy and ethoxy are advantageous as the —OR. The form of —OR and the amount thereof to be introduced to the silane coupling agent however may be appropriately set according to the rate of hydrolysis of the silane coupling agent. The silane coupling agent may contain a plurality of —OR groups. In this instance, the —OR groups may be the same or different.

Examples of the organic silicon compound expressed by formula (1) include allyltrialkoxysilanes, such as allyltrimethoxysilane, allyltriethoxysilane, allyldiethoxymethoxysilane, and allylethoxydimethoxysilane; and allyldialkoxysilanes, such as allyldimethoxysilane and allyldiethoxysilane. Among these, allyltrimethoxysilane and allyltriethoxysilane are advantageous.

(4-2) Liquid Primer

The liquid primer may further contain another silane coupling agent having a functional group such as vinyl, methacryloxypropyl, epoxy, isocyanate, or ureide. It is however advantageous not to use a silane coupling agent containing an amino or a mercapto group as a functional group. These functional groups degrade the catalytic activity of platinum in the silicone rubber composition, thus inhibiting hydrosilylation.

The liquid primer may further contain an organic solvent, silicone polymer, hydrogenated methyl siloxane, alkoxy silane, a catalyst, and a coloring agent, if necessary, in addition to the silane coupling agent.

The silicone polymer is intended to ensure the affinity with the silicone rubber. Examples of the silicone polymer include dimethyl silicone, methylphenyl silicone, and diphenyl silicone.

The alkoxy silane may be added as a film-forming component. Examples of the alkoxy silane include tetraalkoxysilanes, such as tetramethoxysilane and tetraethoxysilane; and alkylalkoxysilane, such as methyltrimethoxysilane and methyltriethoxysilane.

The catalyst is intended to accelerate hydrolysis, condensation or addition reaction. Examples of the catalyst include titanates, tin compounds, and platinum compounds.

The coloring agent may be added for checking the amount of the liquid primer applied. The coloring agent may be carbon black or colcothar.

The liquid primer may be a room temperature dry type (1-part primer) that is used in such a manner that it is applied onto the substrate 3 and is then simply dried with air, or a bake-dry type (2-part primer) that is used in such a manner that it is applied onto the substrate 3 and then baked by heating. A bake-dry type liquid primer is more suitable for ensuring such an adhesion that the elastic layer 4 undergoes cohesive failure without interfacial separation between the substrate 3 and the elastic layer 4 in a 90° peel test specified in JIS K6854-1:1999. This is because bake-dry type primers can satisfactorily induce the reaction between the silane coupling agent and the substrate 3.

One example of such a bake-dry type liquid primer is DY39-104A/B produced by Dow Corning Toray.

Alternatively, there may be used a liquid primer prepared by adding a silane coupling agent having a silicon-bound allyl group to a commercially available bake-dry type liquid primer containing a silane coupling agent other than the silane coupling agent having a silicon-bound allyl group. The silane coupling agent having a silicon-bound allyl group may be, for example, an allyltrimethoxysilane Z-6825 produced by Dow Corning Toray or an allyltriethoxysilane SIA0525.0 produced by Gelest.

(4-3) Surface Treatment with Liquid Primer

The substrate 3 is surface-treated with the liquid primer. Specifically, the liquid primer is applied to the surface of the substrate 3 and the baked, thus forming a primer layer over the surface of the substrate 3. The liquid primer may be dried before baking.

In order to allow silicon-bound allyl groups to be present at the interface between the substrate 3 and the elastic layer 4 of the resulting fixing member, it is important that unreacted allyl groups remain in the silane coupling agent.

The amount per unit area of the primer to be applied to the surface of the substrate 3 may be 0.05 $mg/cm^2$ or more and 1.0 $mg/cm^2$ or less, such as 0.1 $mg/cm^2$ or more and 0.5 $mg/cm^2$ or less. The amount of the primer mentioned herein is the difference of subtracting the mass of the substrate 3 before applying the liquid primer from the mass of the substrate 3 after the liquid primer has been applied thereon and dried and/or baked. Hence, the amount of the primer refers to the total mass of solids in the liquid primer. When the amount of the primer per unit area is 0.05 $mg/cm^2$ or more, silicon-bound allyl groups can remain sufficiently at the interface between the substrate 3 and the elastic layer 4. It is not proper to apply a large amount of liquid primer to the substrate 3 from the viewpoint of imparting appropriate thermal conductivity to the fixing member. Desirably, the amount per unit area of the primer to be applied is 1.0 $mg/cm^2$ or less.

Desirably, the liquid primer applied onto the substrate 3 is baked. When the primer on the substrate 3 is simply air-dried, the condensation reaction of the silane coupling agent does not proceed sufficiently to provide good adhesion.

Desirably, the liquid primer is baked at a temperature of 50° C. or more and 120° C. or less, such as a temperature of 70° C. or more and 90° C. or less. Baking at 120° C. or less allows a sufficient amount of allyl groups to remain in the fixing member without easily deactivating the allyl groups. Bake-dry type liquid primer (2-part primer) is generally baked at a temperature of higher than 120° C. (for example, the above-cited DY39-104 is baked normally at a temperature of about 165° C.). Baking at such a temperature is unlikely to allow allyl groups to remain at the interface between the substrate 3 and the elastic layer 4. Baking at 50° C. or more accentuates the condensation reaction of the silane coupling agent, thereby providing a high adhesion strength between the substrate 3 and the elastic layer 4.

Desirably, the liquid primer is baked for a time period of 30 seconds or more and 60 minutes or less, such as 2 minutes or more and 15 minutes or less. Such a baking time allows sufficient condensation reaction of the silane coupling agent. In addition, allyl groups are prevented from being lost by baking.

Desirably, the primer layer is formed to a small thickness in view of the thermal conductivity of the fixing member. Accordingly, the thickness of the primer layer may be 0.1 μm or more and 10 μm or less.

(4-4) Allyl Groups Between Elastic Layer and Substrate

Silicon-bound allyl groups are present at the interface between the substrate 3 and the elastic layer 4. The presence of the allyl groups can be checked by Fourier transform infrared spectroscopy (FT-IR). It will be described below how to check whether or not allyl groups are present at the interface between the substrate 3 and the elastic layer 4.

The substrate 3 and the elastic layer 4 are forcibly peeled from each other by inserting a razor blade into the interface between the substrate 3 and the elastic layer 4. Then, the peeled surfaces of the substrate 3 and the elastic layer 4 are subjected to infrared spectroscopy by an attenuated total reflection (ATR) method. A silicon-bound allyl group ($\equiv Si—CH_2—CH=CH_2$) exhibits an absorption peak in the range of wavenumbers of 1630 $cm^{-1}$ to 1640 $cm^{-1}$ (P. J. Launer, SILICON COMPOUNDS: SILANES & SILICONES, ed. Gelest, Inc. (2008), pp. 223-226). The presence or absence of silicon-bound allyl groups can be known by the presence or absence of an IR absorption in this range of wavenumbers. When at least one of the peeled surfaces of the substrate 3 and the elastic layer 4 exhibits an absorption peak in the range of wavenumbers of 1630 $cm^{-1}$ to 1640 $cm^{-1}$, it is considered that allyl groups are present at the interface between the substrate 3 and the elastic layer 4. The details of the conditions for infrared spectroscopy will be described in Examples.

(4-5) Peel Test

It is important for the fixing member that the substrate 3 and the elastic layer 4 are bonded to each other so sufficiently as the elastic layer 4 undergoes cohesive failure in a peel test specified in "Adhesives—Determination of peel strength of bonded assemblies" (JIS K6854-1:1999).

Figure 5:
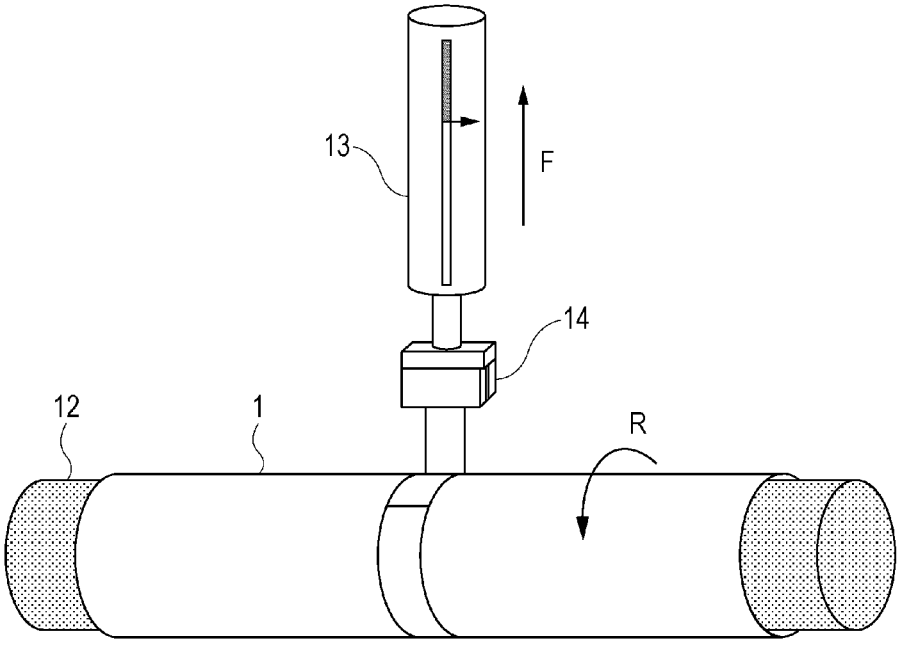
FIG. 5 is a schematic view of a test method for peeling at the interface between the substrate and the elastic layer.

This test will be described in detail with reference to FIG. 5. A slit of 1 cm in width is formed in the fixing member (fixing belt 1 in FIG. 5) from the surface layer 5 to the surface of the substrate 3 along the outer periphery of the fixing member, using a razor blade, with, if necessary, a core 12 inserted in the substrate for preventing the substrate 3 from being deformed. Then, the fixing member is slashed at a position of the slit in the longitudinal direction. This position is defined as the peeling start. At this peeling start, a razor blade is inserted into the interface between the elastic layer 4 and the substrate 3, and they are forcibly peeled from each other about 2 cm in the peripheral direction of the fixing member. The peeling start is pinched by the chuck 14 of a force gauge 13. If the elastic layer 4 is so thin as to easily undergo plastic deformation, a polyimide tape may be put for reinforcement on the surface of the surface layer 5 before forming the slit.

The force gauge 13 is pulled up at a constant speed of 50 mm/min with a tool (not shown) in the direction perpendicular to the tangential direction of the fixing member at the root of the peeling start until the length of the peeled portion of the elastic layer 4 comes to 10 mm, with the core 12 (or the substrate 3, hereinafter the same applied) secured so that the fixing member can be freely rotated in the peripheral direction thereof. At this time, the peeling direction F is kept 90° with respect to the tangential direction of the fixing member at the root of the peeling start. To keep the angle of 90°, first, the peeling start is pinched with the force gauge 13 such that the peeled portion of the elastic layer 4 forms 90°. Subsequently, while the force gauge is pulled up at a constant speed of 50 mm/min in the vertical direction F right above the rotation axis of the core 12, the core 12 is rotated in the direction of arrow R shown in FIG. 5 at a speed in terms of the tangential direction equal to the speed of the movement in the vertical direction F. For example, for a fixing belt 1 having an outer diameter of 30 mm, the angle of 90° can be kept during peeling when the core is rotated at a speed of 0.53 rpm.

The mode of the fractured surface formed by the peel test is evaluated in accordance with "Adhesives-Designation of main failure patterns" (JIS K6866: 1999). Specifically, the mode is either of the following:

Adhesion failure: a fracture of adhesive joint in which it is visible that cracks are present in the adhesive and the interface between the adhesive and the adherend.

Cohesive failure: a fracture of bonded deposit in which it is visible that cracks are present in the adhesive or the adherend.

If the substrate 3 and the elastic layer 4 are appropriately bonded, cohesive failure occurs at the fractured surface of the elastic layer 4. This shows a state where fractured portions of the elastic layer 4 are attached to both the substrate 3 and the elastic layer 4. If cohesive failure and adhesion failure occur in combination at the fractured surface, the mode of fracture of the elastic layer 4 is considered to be cohesive failure when cohesive failure accounts for 50% or more of the peeled area, and it is considered to be adhesive failure when cohesive failure accounts for less than 50%.

(5) Surface Layer

The surface layer 5 may optionally be formed over the surface of the fixing member. The surface layer 5 may be made of a fluororesin. Examples of the fluororesin include tetrafluoroethylene-perfluoro(alkyl vinyl ether) copolymer (PFA), polytetrafluoroethylene (PTFE), tetrafluoroethylene-hexafluoropropylene copolymer (FEP), ethylene-tetrafluoroethylene copolymer (ETFE), polychlorotrifluoroethylene (PCTFE), ethylene-chlorotrifluoroethylene copolymer (ECTFE), and poly vinylidene fluoride (PVDF). These fluororesins may be used singly or in combination.

Among these, PFA is advantageous from the viewpoint of formability and toner releasability.

Although the surface layer 5 can be formed by any method without particular limitation, the following methods may be used: the method of covering the elastic layer 4 with a fluororesin tube made of fluororesin pellets with an adhesive layer therebetween; and the method of applying fluororesin particles directly or a dispersion of fluororesin particles in a solvent onto the surface of the elastic layer 4 and then drying and baking the coating.

In order to control thermal properties, filler may be added into the surface layer 5 in an amount within a range in which formability and releasability are not degraded. The filler may be silica particles, alumina particles, carbon particles, or carbon nanotube.

The thickness of the surface layer 5 may be 10 μm or more and 50 μm or less, desirably 15 μm or more and 30 μm or less. A surface layer 5 having a thickness of 10 μm or more can exhibit high durability, and a surface layer 5 having a thickness of 30 μm or less can exhibit good thermally conductivity.

The surface hardness of the fixing member is desirably 750 or more and 85° or more from the viewpoint of conformability to the surface profile of the recording medium. The surface hardness can be measured with a micro rubber hardness tester MD-1 capa Type C manufactured by Kobunshi Keiki.

2. Fixing Device

The fixing device according to an embodiment of the present disclosure includes the above-described fixing member. In the fixing device, a pair of rotation members, such as a roller and a roller, a film and a roller, a belt and a roller, or a belt and a belt, are disposed so as to be pressed on each other. These members are appropriately selected according to the process speed, dimensions and the like of the image forming apparatus as a whole. In the present embodiment, the structure of an exemplary fixing device will be described.

(1) Fixing Device Using Belt-Shaped Fixing Member

Figure 6:
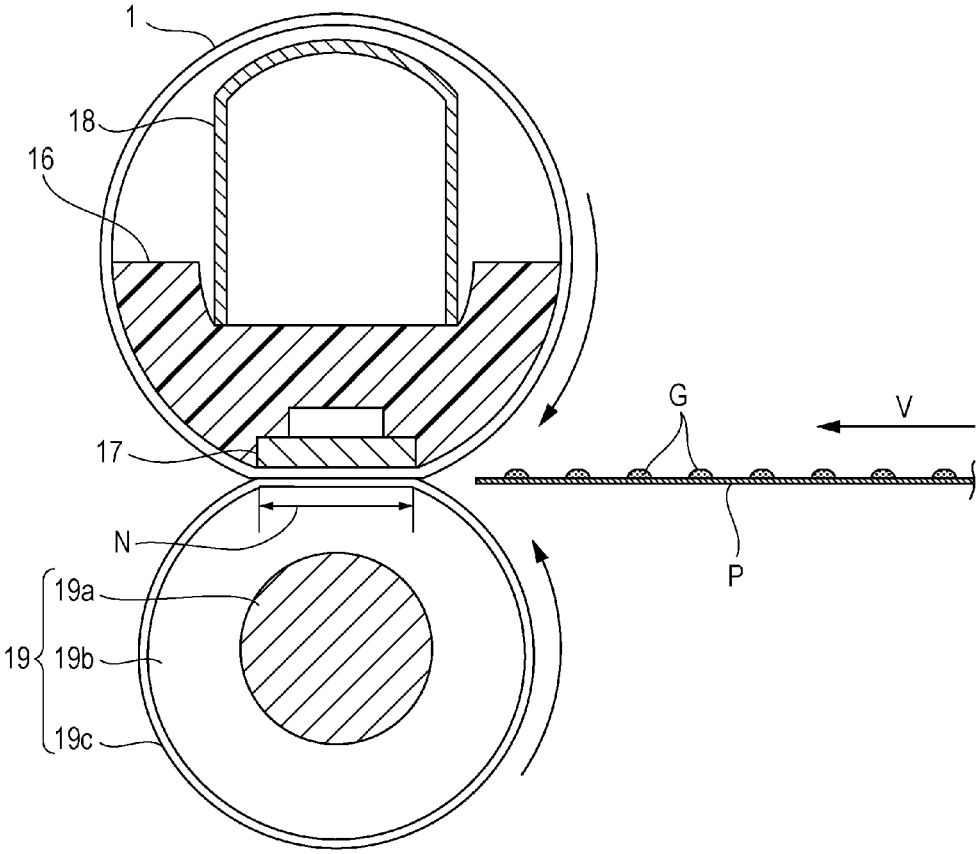
FIG. 6 is a schematic sectional view of a fixing device according to an embodiment of the present disclosure.

FIG. 6 shows a schematic sectional view of a fixing device using a belt-shaped fixing member taken in a lateral direction.

In this fixing device, the fixing belt 1, which is a fixing member according to an embodiment of the present disclosure, is in the form of a seamless belt. The fixing belt 1 is held by a belt guide member 16 made of a heat-resistant, thermally insulating resin.

A ceramic heater 17 is disposed as a heat source at a position where the belt guide member 16 is in contact with the inner surface of the fixing belt 1.

The ceramic heater 17 is secured so as to be fit in a groove in the belt guide member 16 extending in the longitudinal direction of the belt guide member. The ceramic heater 17 is energized by a device (not shown), thereby generating heat.

The seamless fixing belt 1 is loosely put on the periphery of the belt guide member 16. A pressuring rigid stay 18 is disposed through the belt guide 16.

The elastic pressure roller 19 acting as a pressuring member includes a mandrel 19*a* of stainless steel and a silicone rubber elastic layer 19*b* on the mandrel 19*a* for reducing the surface hardness.

The ends of the mandrel 19*a* are rotatably held by bearings between the front and the back side wall of a chassis (not shown).

The elastic pressure roller 19 is covered with a surface layer 19*c* of a 50 μm thick fluororesin tube to improve surface properties and increase releasability.

Pressure springs (not shown) are disposed under compression between each end of the pressuring rigid stay 18 and the corresponding spring receiving member (not shown) at the chassis of the device, thereby applying a downward force to the pressuring rigid stay 18. Thus, the lower surface of the ceramic heater 17 disposed on the lower surface of the belt guide member 16 and the upper surface of the pressuring member 19 are pressed on each other with the fixing belt 1 therebetween, thus forming a predetermined fixing nip N.

A recording medium P to be heated on which an image has been formed with unfixed toner G is conveyed with being pinched to the fixing nip N at a conveyance speed V. Thus, the toner image is heated and pressed. Consequently, the toner image is fused to mix colors and is then fixed to the recording medium P by cooling.

(2) Fixing Device Using Roller-Shaped Fixing Member

Figure 7:
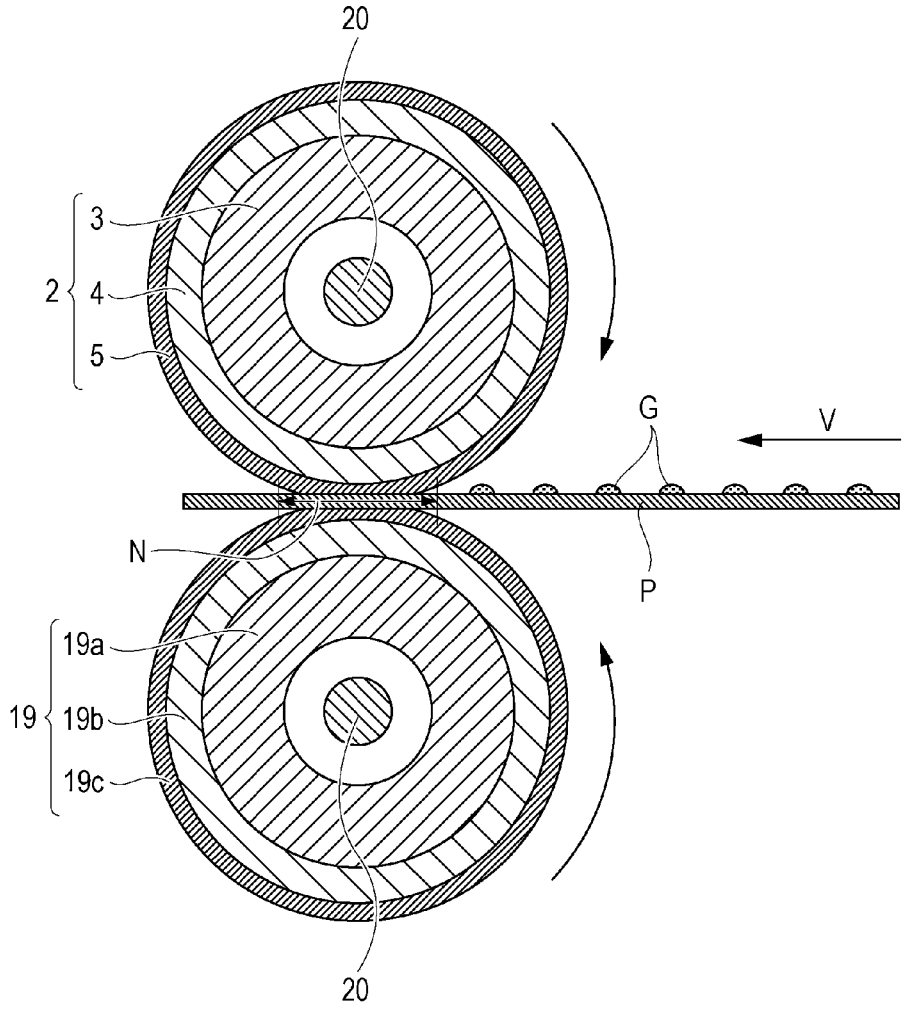
FIG. 7 is a schematic sectional view of a fixing device according to another embodiment of the present disclosure.

FIG. 7 shows a schematic sectional view of a fixing device using a roller-shaped fixing member taken in a lateral direction.

In this fixing device, the fixing roller 2 is a fixing member according to an embodiment of the present disclosure. The fixing roller 2 had an elastic layer 4 on the outer periphery of the substrate 3, and a surface layer 5 covers the periphery of the elastic layer 4.

An elastic pressure roller 19 acting as the pressuring member is disposed so as to oppose the fixing roller 2. These two rollers are rotatably pressed on each other by a pressuring device (not shown), thereby forming a fixing nip N.

The fixing roller 2 and the elastic pressure roller 19 are each provided with a heater 20 or heat source therein for applying heat for fusing the unfixed toner G. The heater 20 is typically a halogen heater. A plurality of halogen heaters may be placed in the rollers, according to the size of the recording medium P to be conveyed.

A rotation force is applied to the fixing roller 2 and the elastic pressure roller 19 from a device (not shown) through the ends of the substrate 3 and the mandrel 19*a*, respectively, thus controlling rotation so that the moving speed of the surface of the fixing roller 2 can be substantially equal to the conveyance speed V of the recording medium. At this time, the rotation force may be applied to either the fixing roller 2 or the elastic roller 19 for rotation, and the other is driven by the rotation, or may be applied to both the rollers.

The recording medium P on which an image has been formed with unfixed toner G is conveyed with being pinched to the fixing nip N of the thus configured fixing device. Thus, the unfixed toner image is heated and pressed. Consequently, the unfixed toner image is fused to mix colors and is then fixed to the recording medium P by cooling.

3. Image Forming Apparatus

The image forming apparatus according to an embodiment of the present disclosure may be an electrophotographic multi-functional peripheral, a copy machine, a facsimile, or a printer. In the following description, the overall structure of a color laser printer will be schematically described by way of example of the image forming apparatus.

Figure 8:
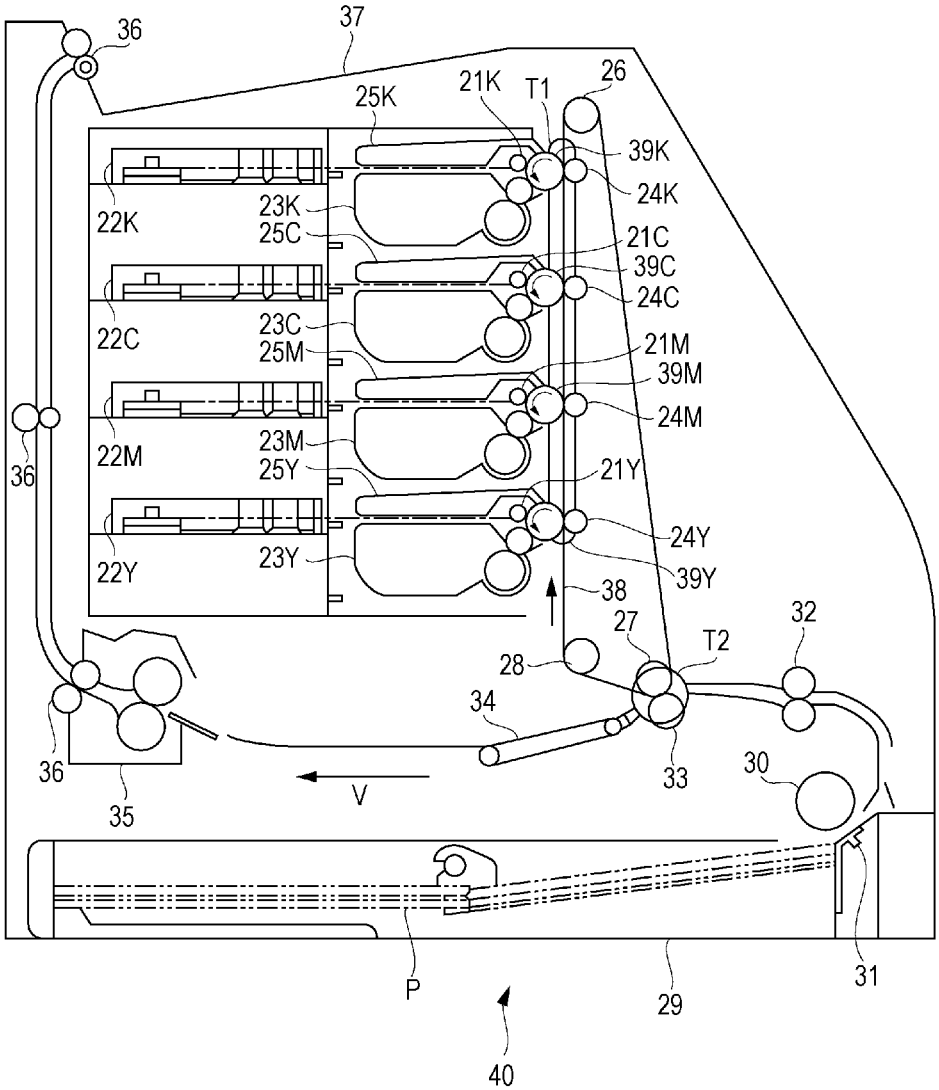
FIG. 8 is a schematic sectional view of an image forming apparatus according to an embodiment of the present disclosure.

FIG. 8 is a schematic sectional view of a color laser printer that is an image forming apparatus incorporating the features of the disclosure.

The color laser printer 40 shown in FIG. 8 includes an image forming section including electrophotographic photosensitive drums 39 (39Y, 39M, 39C, 39K) rotatable at a constant speed, provided for respective colors of yellow (Y), magenta (M), cyan (C) and black (K). Also, the color laser printer 40 includes an intermediate transfer member 38 that holds a multiply transferred color image developed in the image forming section and further transfers the color image to a recording medium P conveyed from a feeding section.

The photosensitive drums 39 (39Y, 39M, 39C and 39K) are each rotated counterclockwise by a driving device (not shown), as shown in FIG. 8.

Each photosensitive drum 39 is provided therearound with a charging device 21 (21Y, 21M, 21C, 21K) adapted to uniformly charge the surface of the photosensitive drum 39, a scanner unit 22 (22Y, 22M, 22C, 22K) adapted to emit a laser beam according to image information to form an electrostatic latent image on the photosensitive drum 39, a developing unit 23 (23Y, 23M, 23C, 23K) adapted to attach toner to the electrostatic latent image and develop it into a toner image, a primary transfer roller 24 (24Y, 24M, 24C, 24K) adapted to transfer the toner image on the photosensitive drum 39 to the intermediate transfer member 38 in a primary transfer section T1, and a cleaning unit 25 (25Y, 25M, 25C, 25K) having a cleaning blade adapted to remove the toner remaining on the surface of the photosensitive drum 39 after the transfer, in that order in the rotation direction of the photosensitive drum 39.

For forming an image, on rotating a belt-shaped intermediate transfer member 38 stretched on rollers 26, 27 and 28, toner images with respective colors formed on the photosensitive drums 39 are superimposed on the intermediate transfer member 38 by primary transfer, thus forming a color image.

The recording medium P is conveyed to a secondary transfer section T2 by a conveying device so as to synchronize with the primary transfer to the intermediate transfer member 38. The conveying device includes a feeding cassette 29 containing a plurality of recording media P, a feeding roller 30, a separation pad 31, and a pair of resist rollers 32. When an image is formed, the feeding roller 30 rotates in response to image forming operation so that one of the recording media P in the feeding cassette 29 is separated from the others and conveyed to the secondary transfer section T2 by the pair of resist rollers 32 at a timing corresponding to the image forming operation.

A movable secondary transfer roller 33 is disposed in the secondary transfer section T2. The secondary transfer roller 33 is reciprocally movable in substantially vertical directions. For transferring an image, the secondary transfer roller 33 is pressed on the intermediate transfer member 38 at a predetermined pressure with the recording medium P therebetween. At this time, a bias is simultaneously applied to the secondary transfer roller 33, and thus the toner image on the intermediate transfer member 38 is transferred to the recording medium P.

Since the intermediate transfer member 38 and the secondary transfer roller 33 are each driven, the recording medium P between the intermediate transfer member 38 and the secondary transfer roller 33 is conveyed in the direction of the leftward arrow shown in FIG. 8 at a speed V and then further conveyed to a fixing section 35 for a subsequent operation by the conveying belt 34. The fixing section 35 acts as the fixing device according to an embodiment of the present disclosure. The fixing section 35 fixes the transferred toner image to the recording medium P by applying heat and pressure. Then, the recording medium P is ejected onto an ejection tray 37 by a pair of ejecting rollers 36.

EXAMPLES

One or more embodiments of the present disclosure will now be further described with reference to Examples. The conditions of fixing belts prepared for Examples and Comparative Examples are shown in Table 1.

Example 1

Preparation of Fixing Belt

First, a nickel-electroformed endless sleeve of 30 mm in diameter, 400 mm in width and 40 μm in thickness was prepared as the substrate. The endless sleeve was handled with a core inserted therein.

Subsequently, the outer periphery of the substrate was treated with a primer. Specifically, liquid A and liquid B of a bake-dry type primer containing allyltrimethoxysilane (DY39-104A/B, produced by Dow Corning Toray) were mixed in a ratio of 1:1, and the mixture was diluted three times (in terms of mass) with n-heptane. The resulting liquid primer was uniformly applied onto the outer periphery of the substrate. After the solvent was evaporated, the liquid primer was baked at 80° C. for 4 minutes in an electric furnace. The amount of the primer applied, which was calculated determining the mass change of the substrate before the primer was applied and the mass of the substrate after baking, was 0.1 mg/cm$^2$.

Subsequently, a silicone rubber composition was prepared. A dimethylsiloxane polymer having vinyl groups at both ends of the molecule thereof and having an average molecular weight of 6000 was prepared as the base polymer. Also, a methyl hydrogen silicone polymer containing 19.5% of hydrosilyl groups relative to the methyl hydrogen silicone polymer was prepared as the silicone polymer as a cross-linking agent. The prepared materials were mixed in a mass ratio of 90:10. Furthermore, a trace amount of hydrosilylation catalyst (platinum catalyst: platinum carbonylcyclovinylmethylsiloxane complex) and a trace amount of inhibitor were added and mixed well.

To the resulting mixture were added anatase titanium oxide particles (anatase titanium oxide (IV) 208-18231, produced by Wako Pure Chemical Industries, volume average primary particle size: 30 nm, represented as $TiO_2$ (a) in Table 1) as a heat resistant filler to a filling factor of 2% by volume, and alumina (alumina beads CB-A20S, produced by Showa Denko, average particle size: 21 μm) as a thermally conductive filler to a filling factor of 40% by volume. The materials were sufficiently mixed to yield a silicone rubber composition. The filling factor mentioned herein is a value relative to the volume of the entire silicone rubber composition.

The thus prepared silicone rubber composition was applied to a thickness of 300 μm onto the primer-treated substrate by ring coating. The resulting endless belt was heated in an electric furnace of 200° C. for 4 hours to cure the silicone rubber, and thus an elastic layer was formed.

While the endless belt was rotated in such a manner that the surface thereof moved in a peripheral direction at a speed of 20 mm/s, the surface was irradiated with UV light from a UV lamp disposed at a distance of 10 mm from the surface. The UV lamp was a low-pressure mercury-vapor lamp GLQ 500US/1 manufacture by Harrison Toshiba Lighting, and the irradiation was performed at 100° C. in the air for 5 minutes.

After cooling the endless belt to room temperature, an addition-curable silicone rubber adhesive (SE1819CV A/B, produced by Dow Corning Toray) was uniformly applied to a thickness of about 20 μm onto the surface of the elastic layer of the endless belt.

Then, a fluororesin tube of 29 mm in diameter and 20 μm in thickness (KURANFLON-LT, manufactured by Kurabo) was laminated on the elastic layer while the diameter thereof was being expanded. Then, the surface of the belt was evenly squeezed through the hand with the fluororesin tube therebetween, so that excess adhesive was squeezed out between the elastic layer and the fluororesin tube.

The fluororesin tube was fixed to the elastic layer by heating the endless belt in an electric furnace of 200° C. for 1 hour to cure the adhesive. Both ends of the resulting endless belt were cut off, and thus fixing belt No. 1 of 341 mm in width was completed.

Evaluation of Fixing Belt

Fixing belt No. 1 was subjected to the following tests (1) to (3) for evaluation. Evaluation results are shown together in Table 2.

(1) Presence or Absence of Silicon-Bound Allyl Groups

For checking whether silicon-bound allyl groups were present at the interface between the substrate and the elastic layer, fixing belt No. 1 was subjected to infrared spectroscopy as below using an infrared spectrometer Frontier FT IR manufactured by PerkinElmer.

The substrate and the elastic layer of fixing belt No. 1 were forcibly peeled from each other to expose their interface by inserting a razor blade into the interface. The peeled surfaces of the substrate and the elastic layer were subjected to infrared spectroscopy by an attenuated total reflection (ATR) method, and it was checked whether or not the peak peculiar to the silicon-bound allyl group appeared in the range of wavenumbers of 1630 $cm^{-1}$ to 1640 $cm^{-1}$.

Measuring Conditions:

ATR crystal: diamond

Scanning range: 4000 $cm^{-1}$ to 450 $cm^{-1}$

Number of scans: 4

Resolution: 4 $cm^{-1}$

Incident angle: 45°

Figure 9A:
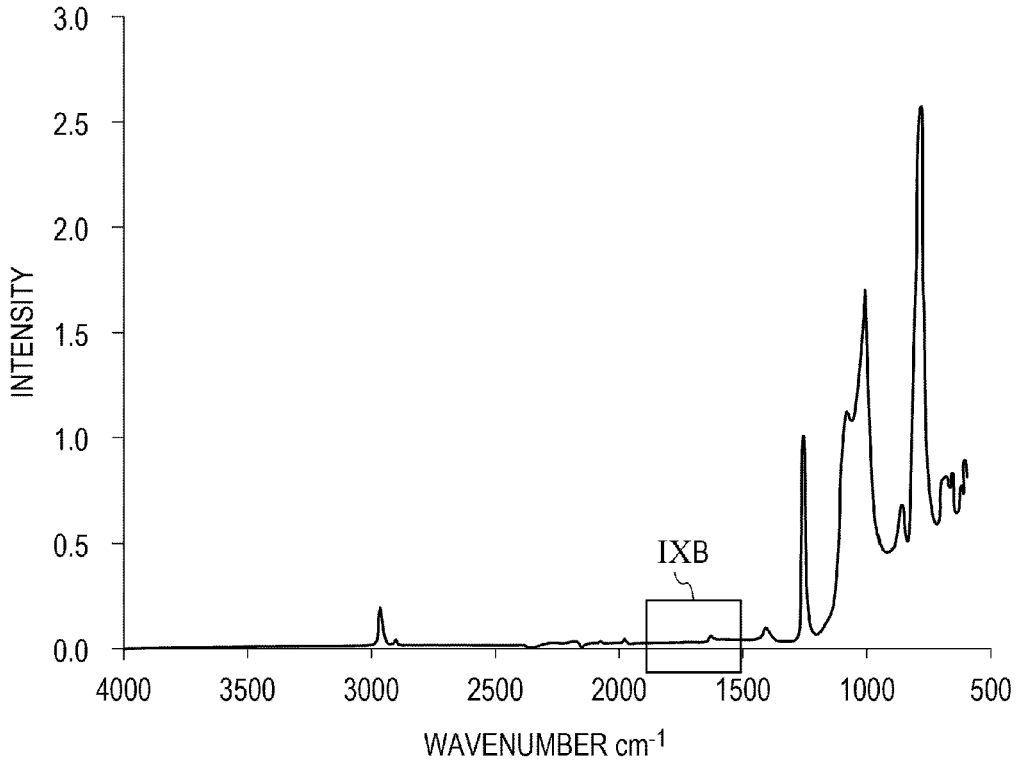
FIG. 9A is an IR spectrum chart of a peeled surface of the substrate of fixing belt No. 1.
Figure 9B:
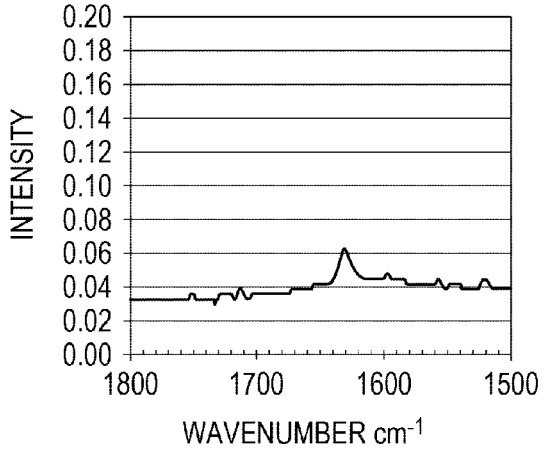
FIG. 9B is an enlarged chart of portion IXB in FIG. 9A.

When both peeled surfaces did not exhibit the peak peculiar to the allyl group, the sample was determined to be "allyl is absent"; when either of the peeled surfaces exhibited the peak peculiar to the allyl group, the sample was determined to be "allyl is present". For fixing belt No. 1, the peeled surface of the substrate exhibited the peak peculiar to the silicon-bound allyl group. FIG. 9 shows the IR spectrum chart of the peeled surface of the substrate.

(2) Peel Test

Peel test was performed on the interface between the substrate and the elastic layer of fixing belt No. 1.

When the interface between the substrate and the elastic layer of fixing belt No. 1 in the initial state was subjected to peel test for the mode of fracture, cohesive failure occurred in the elastic layer.

Furthermore, high-temperature, long-time use of the fixing belt was simulated for evaluation. Fixing belt No. 1 was exposed to a high temperature of 250° C. for 500 hours in total in a hot air circulating oven. After 300 hours and 500 hours each, the fixing belt was cooled to room temperature and subjected to peel test for the interface between the substrate and the elastic layer in the same manner as above. As a result, cohesive failure occurred in the elastic layer in both tests after 300 and 500 hours.

Example 2

Liquid A and liquid B of a primer containing allyltrimethoxysilane (DY39-104A/B, produced by Dow Corning Toray) were mixed in a ratio of 1:1, and the mixture was diluted 1.6 times (in terms of mass) with n-heptane. Thus a liquid primer was prepared. Except for using the thus prepared liquid primer, fixing belt No. 2 was produced in the same manner as in Example 1 and was subjected to test for evaluation. The amount of the primer applied onto the substrate was 0.2 $mg/cm^2$. The evaluation results are shown in Table 2.

Example 3

Fixing belt No. 3 was produced in the same manner as in Example 1 except that the liquid primer was applied as it was without being diluted with n-heptane, and was subjected to test for evaluation. The evaluation results are shown in Table 2. The amount of the primer applied onto the substrate was 0.5 $mg/cm^2$.

Example 4

Liquid A and liquid B of a bake-dry type primer containing 3-methacryloxypropyltrimethoxysilane (DY39-051A/B, produced by Dow Corning Toray) were mixed in a ratio of 1:1. To 100 parts by mass of the primer was added 5 parts by mass of allyltrimethoxysilane (Z-6825, produced by Dow Corning Toray) as a silane coupling agent. Then, the mixture was diluted 5 times (in terms of mass) with n-heptane to yield a liquid primer. Except for using the thus prepared liquid primer, fixing belt No. 4 was produced in the same manner as in Example 1 and was subjected to test for evaluation. The evaluation results are shown in Table 2. The amount of the primer applied onto the substrate was 0.3 $mg/cm^2$.

Example 5

Liquid A and liquid B of a bake-dry type primer containing 3-methacryloxypropyltrimethoxysilane (DY39-051A/B, produced by Dow Corning Toray) were mixed in a ratio of 1:1. To 100 parts by mass of the primer was added 5 parts by mass of allyltriethoxysilane (SIA0525.0, produced by Gelest, Inc.) as a silane coupling agent. Then, the mixture was diluted 5 times (in terms of mass) with n-heptane to yield a liquid primer. The liquid primer was applied to the substrate and baked at 80° C. for 15 minutes. Except for these operations, fixing belt No. 5 was produced in the same manner as Example 1 and was subjected to test for evaluation. The evaluation results are shown in Table 2. The amount of the primer applied was 0.3 $mg/cm^2$.

Comparative Example 1

Liquid A and liquid B of a primer containing 3-methacryloxypropyltrimethoxysilane (DY39-051A/B, produced by Dow Corning Toray) were mixed in a ratio of 1:1, and the mixture was diluted 6 times (in terms of mass) with n-heptane. Thus a liquid primer was prepared without adding a silane coupling agent having an allyl group. Except for using the thus prepared liquid primer, fixing belt No. 6 was produced in the same manner as in Example 1 and was subjected to test for evaluation. The evaluation results are shown in Table 2. The amount of the primer applied was 0.1 $mg/cm^2$.

Comparative Examples 2 and 3

Fixing belts No. 7 and No. 8 were produced in the same manner as in Comparative Example 1 except that the primer was diluted 3 times and 2.3 times, respectively, with n-heptane and that baking was performed at 165° C. for 4 minutes. The resulting fixing belts were subjected to test for evaluation. The results are shown in Table 2.

Comparative Example 4

Fixing belt No. 9 was produced in the same manner as in Example 3 except that the liquid primer was baked at 165° C. for 4 minutes, and was subjected to test for evaluation. The evaluation results are shown in Table 2.

For fixing belt No. 9, the interface between the substrate and the elastic layer was analyzed by an ATR method in the same manner as in Example 1. As a result, the presence of silicon-bound allyl groups was not confirmed. This is probably because the baking of the liquid primer for fixing belt No. 9 was performed at a higher temperature than in Example 1, consequently deactivating allyl groups.

Comparative Example 5

Fixing belt No. 10 was produced in the same manner as in Example 4 except that 5 parts by mass of vinyltrimethoxysilane (Z-6300, produced by Dow Corning Toray) was added instead of allyltrimethoxysilane, and was subjected to test for evaluation. The evaluation results are shown in Table 2.

Comparative Example 6

A primer containing allyltrimethoxysilane (DY39-067, produced by Dow Corning Toray) was uniformly applied, as it was without being diluted, to a thickness of about 10 μm on the endless belt including the elastic layer produced in Example 1. The coating of the primer was dried at room temperature for 30 minutes. Then, the sample was covered with a fluororesin tube in the same manner as in Example 1 to yield fixing belt No. 11, and the belt was subjected to test for evaluation. The evaluation results are shown in Table 2. The amount of the primer applied was 0.01 mg/cm$^2$.

Although the primer used for fixing belt No. 11 contained allyltrimethoxysilane, fixing belt No. 11 did not exhibit satisfactory adhesion even in the early stage. The primer was room temperature dry type (1-part primer), which is air-dried without being baked. Consequently, the dehydration (condensation) of the silane coupling agent and the OH groups at the substrate of the substrate does not proceed sufficiently. This is probably the reason why the adhesion strength was low. Also, the reason why the presence of allyl groups was not confirmed is probably that a sufficient amount of primer was not applied because of the low viscosity of the primer.

Reference Example

First, the same primer as used in Comparative Example 2 was applied onto the substrate under the same conditions as in Comparative Example 2, and baked.

Subsequently, a silicone rubber composition was prepared as below. A silicone rubber composition was prepared in the same manner as in Example 1, except that titanium oxide particles having a rutile crystal structure (rutile titanium oxide (IV) 203-09413, 99.9%, produced by Wako pure Chemical Industries, volume average primary particle size: 30 nm, represented as $TiO_2$ (r) in Table 1) was added instead of the anatase titanium oxide particles.

Except for using the thus prepared silicone rubber composition, fixing belt No. 12 was produced in the same manner as in Comparative Example 2 and was subjected to test for evaluation. The evaluation results are shown in Table 2.

TABLE 1

| | Fixing belt No. | Substrate | Primer: Type | Primer: Silane coupling agent | Primer: Baking conditions (° C., min) | Primer: Weight of primer applied (mg/cm$^2$) | Silicone rubber composition: Rubber | Silicone rubber composition: Filler and Content |
|---|---|---|---|---|---|---|---|---|
| Example 1 | 1 | Ni | DY39-104 | Allyltrimethoxysilane | 80° C., 4 min | 0.1 | Addition-curable | $TiO_2$ (a): 2 vol % $Al_2O_3$: 40 vol % |
| Example 2 | 2 | Ni | DY39-104 | Allyltrimethoxysilane | 80° C., 4 min | 0.2 | Addition-curable | $TiO_2$ (a): 2 vol % $Al_2O_3$: 40 vol % |
| Example 3 | 3 | Ni | DY39-104 | Allyltrimethoxysilane | 80° C., 4 min | 0.5 | Addition-curable | $TiO_2$ (a): 2 vol % $Al_2O_3$: 40 vol % |
| Example 4 | 4 | Ni | DY39-051<br>Z-6825 | 3-Methacryloxy propyltrimethoxysilane<br>Allyltrimethoxysilane | 80° C., 4 min | 0.3 | Addition-curable | $TiO_2$ (a): 2 vol % $Al_2O_3$: 40 vol % |
| Example 5 | 5 | Ni | DY39-051<br>SIA0525.0 | 3-Methacryloxy propyltrimethoxysilane<br>Allyltriethoxysilane | 80° C., 15 min | 0.3 | Addition-curable | $TiO_2$ (a): 2 vol % $Al_2O_3$: 40 vol % |
| Comparative Example 1 | 6 | Ni | DY39-051 | 3-Methacryloxy propyltrimethoxysilane | 80° C., 4 min | 0.1 | Addition-curable | $TiO_2$ (a): 2 vol % $Al_2O_3$: 40 vol % |
| Comparative Example 2 | 7 | Ni | DY39-051 | 3-Methacryloxy propyltrimethoxysilane | 165° C., 4 min | 0.2 | Addition-curable | $TiO_2$ (a): 2 vol % $Al_2O_3$: 40 vol % |
| Comparative Example 3 | 8 | Ni | DY39-051 | 3-Methacryloxy propyltrimethoxysilane | 165° C., 4 min | 0.5 | Addition-curable | $TiO_2$ (a): 2 vol % $Al_2O_3$: 40 vol % |
| Comparative Example 4 | 9 | Ni | DY39-104 | Allyltrimethoxysilane | 165° C., 4 min | 0.5 | Addition-curable | $TiO_2$ (a): 2 vol % $Al_2O_3$: 40 vol % |
| Comparative Example 5 | 10 | Ni | DY39-051<br>Z-6300 | 3-Methacryloxy propyltrimethoxysilane<br>Vinytrimethoxysilane | 80° C., 4 min | 0.3 | Addition-curable | $TiO_2$ (a): 2 vol % $Al_2O_3$: 40 vol % |
| Comparative Example 6 | 11 | Ni | DY39-067 | Allyltrimethoxysilane | Air dry | 0.01 | Addition-curable | $TiO_2$ (a): 2 vol % $Al_2O_3$: 40 vol % |
| Reference Example 1 | 12 | Ni | DY39-051 | 3-Methacryloxy propyltrimethoxysilane | 165° C., 4 min | 0.2 | Addition-curable | $TiO_2$ (r): 2 vol % $Al_2O_3$: 40 vol % |

TABLE 2

| | Fixing belt No. | (1) Presence of silicon-bound allyl at substrate-elastic layer interface | (2) Mode of fracture in substrate/elastic layer interface peel test: Initial | After 300 hours | After 500 hours |
|---|---|---|---|---|---|
| Example 1 | 1 | Present | Cohesive failure in elastic layer | Cohesive failure in elastic layer | Cohesive failure in elastic layer |
| Example 2 | 2 | Present | Cohesive failure in elastic layer | Cohesive failure in elastic layer | Cohesive failure in elastic layer |
| Example 3 | 3 | Present | Cohesive failure in elastic layer | Cohesive failure in elastic layer | Cohesive failure in elastic layer |

TABLE 2-continued

| | Fixing belt No. | (1) Presence of silicon-bound allyl at substrate-elastic layer interface | (2) Mode of fracture in substrate/elastic layer interface peel test | | |
|---|---|---|---|---|---|
| | | | Initial | After 300 hours | After 500 hours |
| Example 4 | 4 | Present | Cohesive failure in elastic layer | Cohesive failure in elastic layer | Cohesive failure in elastic layer |
| Example 5 | 5 | Present | Cohesive failure in elastic layer | Cohesive failure in elastic layer | Cohesive failure in elastic layer |
| Comparative Example 1 | 6 | Absent | Adhesion failure between substrate and elastic layer | — | — |
| Comparative Example 2 | 7 | Absent | Cohesive failure in elastic layer | Adhesion failure between substrate and elastic layer | — |
| Comparative Example 3 | 8 | Absent | Cohesive failure in elastic layer | Cohesive failure in elastic layer | Adhesion failure between substrate and elastic layer |
| Comparative Example 4 | 9 | Absent | Adhesion failure between substrate and elastic layer | — | — |
| Comparative Example 5 | 10 | Absent | Cohesive failure in elastic layer | Adhesion failure between substrate and elastic layer | — |
| Comparative Example 6 | 11 | Absent | Adhesion failure between substrate and elastic layer | — | — |
| Reference Example 1 | 12 | Absent | Cohesive failure in elastic layer | Cohesive failure in elastic layer | Cohesive failure in elastic layer |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-001045, filed on Jan. 6, 2015, and No. 2015-057751, filed on Mar. 20, 2015 which are hereby incorporated by reference herein in their entirety.

What is claimed is:

1. A fixing member comprising:

a substrate; and an elastic layer on the substrate, the elastic layer comprising a cured product of a silicone rubber composition containing a titanium oxide particle having an anatase crystal structure and an addition-curable silicone rubber, wherein the elastic layer undergoes cohesive failure in a 90° peel test specified in JIS K6854-1:1999, and wherein an allyl group bound to an silicon atom is present at the interface between the substrate and the elastic layer.

2. The fixing member according to claim 1, wherein when the substrate and the elastic layer are forcibly peeled from each other and the peeled surfaces are subjected to infrared spectroscopy by an attenuated total reflection method, at least one of infrared absorption spectra of the peeled surfaces of the substrate and the elastic layer has an absorption peak in the range of wavenumbers of 1630 $cm^{-1}$ to 1640 $cm^{-1}$.

3. The fixing member according to claim 1, wherein the allyl group derives from a silane coupling agent containing an allyl group bound to a silicon atom.

4. The fixing member according to claim 1, wherein the elastic layer has a tensile strength specified in JIS K6251: 2010 of 0.4 MPa or more and 3.0 MPa or less.

5. A method for manufacturing a fixing member including a substrate, and an elastic layer on the substrate that is a cured product of a silicone rubber composition comprising a titanium oxide particle having an anatase crystal structure and an addition-curable silicone rubber, and that undergoes cohesive failure in 90° peel test specified in JIS K6854-1: 1999, wherein an allyl group bound to a silicon atom is present at the interface between the substrate and the elastic layer, the method comprising the steps of:

applying a primer containing a silane coupling agent having an allyl group bound to a silicon atom onto a substrate;

baking the primer at a temperature of 50° C. or more and 120° C. or less;

forming a layer of a silicone rubber composition on the substrate after baking the primer, the silicone rubber composition containing a titanium oxide particle having an anatase crystal structure and an addition-curable silicone rubber; and curing the silicone rubber in the layer.

6. The method according to claim 5, wherein the silane coupling agent contains an organic silicon compound expressed by the following formula (1) or a condensate thereof:

$$CH_2{=}CH{-}CH_2{-}Si({-}CH_3)_n({-}OR)_{3-n} \quad (1),$$

wherein 'OR' is selected from the group consisting of alkoxy and carboxy, and n represents an integer of 1 to 3.

7. The method according to claim 6, wherein 'OR' in the formula (1) is methoxy or ethoxy.

8. An image forming apparatus comprising:

a fixing device configured to fix an unfixed toner image formed on a recording medium to the recording medium by heating and pressing, the fixing device including a fixing member, wherein the fixing member includes a substrate, and an elastic layer on the substrate, the elastic layer comprising a cured product of a silicone rubber composition containing an anatase titanium oxide particle and an addition-curable silicone rubber, wherein the elastic layer undergoes cohesive failure in 90° peel test specified in JIS K6854-1:1999, and wherein an allyl group bound to a silicon atom is present at the interface between the substrate and the elastic layer.

* * * * *